US011284721B2

(12) United States Patent
Browning et al.

(10) Patent No.: US 11,284,721 B2
(45) Date of Patent: Mar. 29, 2022

(54) DISENGAGEMENT AND REENGAGEMENT MECHANISM ON MOTORIZED SEATING UNIT FOR SELECTIVE MANUAL CONTROL

(71) Applicant: L&P PROPERTY MANAGEMENT COMPANY, South Gate, CA (US)

(72) Inventors: Caleb Browning, Carthage, MO (US); Ronald D. Davis, Joplin, MO (US); Randy Ford, Carthage, MO (US); Vino Gopalakrishnan, Carthage, MO (US); David Purser, Carthage, MO (US)

(73) Assignee: L&P PROPERTY MANAGEMENT COMPANY, South Gate, CA (US)

( * ) Notice: Subject to any disclaimer, the term of this patent is extended or adjusted under 35 U.S.C. 154(b) by 0 days.

(21) Appl. No.: 16/943,614

(22) Filed: Jul. 30, 2020

(65) Prior Publication Data

US 2020/0352334 A1 Nov. 12, 2020

Related U.S. Application Data

(63) Continuation-in-part of application No. 16/834,321, filed on Mar. 30, 2020.

(60) Provisional application No. 62/826,335, filed on Mar. 29, 2019.

(51) Int. Cl.

| | |
|---|---|
| ***A47C 1/035*** | (2006.01) |
| ***A47C 1/0355*** | (2013.01) |
| ***A47C 7/50*** | (2006.01) |

(52) U.S. Cl.

CPC ..... *A47C 1/0355* (2013.01); *A47C 7/506* (2013.01)

(58) Field of Classification Search

CPC .... A47C 1/0355; A47C 1/03211; A47C 7/506

See application file for complete search history.

(56) References Cited

U.S. PATENT DOCUMENTS

| | | | |
|---|---|---|---|
| 3,730,585 | A | 5/1973 | Rogers, Jr. et al. |
| 4,071,275 | A | 1/1978 | Rogers, Jr. |
| 4,577,902 | A | 3/1986 | Crum |
| 5,730,494 | A | 3/1998 | LaPointe et al. |

(Continued)

FOREIGN PATENT DOCUMENTS

| | | | |
|---|---|---|---|
| CN | 102133006 | A | 7/2011 |
| CN | 102894699 | A | 1/2013 |

(Continued)

OTHER PUBLICATIONS

International Search Report and Written Opinion received for PCT Patent Application No. PCT/US2021/042477, dated Aug. 17, 2021, 7 pages.

(Continued)

*Primary Examiner* — Shin H Kim

(74) *Attorney, Agent, or Firm* — Shook Hardy & Bacon, LLP

(57) ABSTRACT

A motorized positioning apparatus for a seating unit includes a motor assembly that is configured to move a pair of linkage mechanisms though a series of positions that arrange the seating unit in a closed position, open position, or extended position. The motor assembly is selectively and releasably coupled to the linkage mechanisms, to allow the motor assembly to be manually closed by the user and automatically coupled via a coupling mechanism.

20 Claims, 10 Drawing Sheets

(56) References Cited

U.S. PATENT DOCUMENTS

| | | | | |
|---|---|---|---|---|
| 6,142,558 | A | 11/2000 | May | |
| 6,840,575 | B2 | 1/2005 | Hesse | |
| 7,641,277 | B2 | 1/2010 | Lawson et al. | |
| 8,308,228 | B2 | 11/2012 | Lawson et al. | |
| 8,398,165 | B2 | 3/2013 | Lawson | |
| 9,247,822 | B2 | 2/2016 | Fischer | |
| 9,386,857 | B2 * | 7/2016 | Lawson | A47C 7/24 |
| 9,585,477 | B2 | 3/2017 | Huang et al. | |
| 9,845,852 | B2 | 12/2017 | Lawson et al. | |
| 10,842,274 | B1 * | 11/2020 | Crawford | A47C 1/0355 |
| 2001/0035668 | A1 | 11/2001 | Gaffney et al. | |
| 2008/0258512 | A1 | 10/2008 | Rogers | |
| 2010/0127538 | A1 * | 5/2010 | Hoffman | A47C 3/18 297/68 |
| 2011/0181094 | A1 | 7/2011 | Lawson et al. | |
| 2011/0233972 | A1 | 9/2011 | Weicek | |
| 2011/0304193 | A1 | 12/2011 | Murphy et al. | |
| 2012/0286557 | A1 * | 11/2012 | Hoffman | A47C 1/03211 297/85 M |
| 2012/0299363 | A1 * | 11/2012 | Crum | A47C 1/0352 297/85 M |
| 2013/0175846 | A1 | 7/2013 | Lawson | |
| 2013/0234477 | A1 | 9/2013 | Sichelschmidt | |
| 2014/0035395 | A1 | 2/2014 | Marcantoni | |
| 2014/0049084 | A1 | 2/2014 | Lawson et al. | |
| 2015/0054315 | A1 * | 2/2015 | Donovan | A47C 1/0345 297/68 |
| 2015/0282619 | A1 | 10/2015 | Lawson | |
| 2016/0022040 | A1 * | 1/2016 | Lawson | A47C 1/0355 297/68 |
| 2016/0106215 | A1 * | 4/2016 | Crum | A47C 1/035 297/68 |
| 2017/0042330 | A1 | 2/2017 | Bruce et al. | |
| 2018/0161223 | A1 * | 6/2018 | Murphy | A47C 1/0242 |
| 2018/0242740 | A1 * | 8/2018 | Lawson | A47C 1/0345 |
| 2019/0290004 | A1 * | 9/2019 | Lawson | A47C 1/0355 |
| 2020/0113333 | A1 * | 4/2020 | Crum | A47C 1/0355 |
| 2020/0275781 | A1 * | 9/2020 | Lawson | A47C 1/03211 |
| 2020/0305604 | A1 * | 10/2020 | Browning | A47C 1/03211 |
| 2020/0352334 | A1 * | 11/2020 | Browning | A47C 7/506 |
| 2020/0367652 | A1 * | 11/2020 | Crawford | A47C 1/0355 |
| 2021/0100364 | A1 * | 4/2021 | Murphy | A47C 1/0355 |

FOREIGN PATENT DOCUMENTS

| | | | |
|---|---|---|---|
| CN | 103584536 | A | 2/2014 |
| CN | 103932521 | A | 7/2014 |
| CN | 104799597 | A | 7/2015 |
| CN | 204427259 | U | 7/2015 |
| CN | 204561549 | A | 8/2015 |
| CN | 104936483 | A | 9/2015 |
| CN | 105686429 | A | 6/2016 |
| CN | 105705063 | A | 6/2016 |
| CN | 205338272 | U | 6/2016 |
| CN | 105962667 | A | 9/2016 |
| DE | 27 1 2 308 | A1 | 9/1977 |
| WO | 2012/125280 | A2 | 9/2012 |
| WO | 2014/139179 | A1 | 9/2014 |
| WO | 2015/066030 | A1 | 5/2015 |

OTHER PUBLICATIONS

Second Office Action and Search received for Chinese Patent Application No. 201710637996.0, dated Nov. 11, 2021, 23 pages. (English Translation Submitted).

* cited by examiner

DISENGAGEMENT AND REENGAGEMENT MECHANISM ON MOTORIZED SEATING UNIT FOR SELECTIVE MANUAL CONTROL

CROSS REFERENCE TO RELATED APPLICATIONS

This application is a continuation-in-part of U.S. non-provisional application Ser. No. 16/834,321 entitled "DISENGAGEMENT AND REENGAGEMENT MECHANISM ON MOTORIZED SEATING UNIT FOR SELECTIVE MANUAL CONTROL" which was filed on Mar. 30, 2020 and claims the benefit of U.S. provisional application 62/826,335, entitled "DISENGAGEMENT AND REENGAGEMENT MECHANISM ON MOTORIZED SEATING UNIT FOR SELECTIVE MANUAL CONTROL" filed on Mar. 29, 2019, and wherein the entirety of the application has been incorporated by reference herein.

BACKGROUND

Motorized motion furniture exists that moves an article of furniture, such as, for example, a seating unit such as a recliner chair or a portion of a sectional, between a closed position, an open or TV position, and a reclined position. These furniture items typically have a pair of metal linkage mechanisms that control the positioning of an ottoman, a seat and a backrest. In the closed position, the seat is generally horizontal, with the ottoman stored in a closed position and the back generally upright. In the TV position, the ottoman is extended, and the seat and back generally maintain their respective positions. In the reclined position, the ottoman is further extended, the seat may move forward and down, and the back is reclined. In the motorized versions of this furniture, a linear actuator or motor is connected to the linkage mechanisms that control the movement of the ottoman, seat and back. By engaging the actuator, the furniture item is moved between positions, such as from the closed position to the TV position and to the reclined position (and back).

Generally, if a user of such a piece of motion furniture wishes to exit the motion furniture, the user will engage the actuator (such as with a button, or switch) to return the motion furniture to the closed position. For example, if the user has the motion furniture in a TV position, and wishes to exit the motion furniture, the user will press an appropriate button (possibly labeled "back" or "return" or "close") to engage the actuator, which moves the linkage mechanisms to control the ottoman, seat and back as the motion furniture returns to the closed position. But, the movement of the actuator can be somewhat slow. It would be useful and advantageous to allow a user to return the motion furniture to the closed position in a faster, manual way. As an example, if a user needs to answer a phone located remotely from the motion furniture, or needs to answer the door, or if the user is simply impatient, the user may not want to wait for the actuator to return the motion furniture to the closed position before exiting the motion furniture. It would also be advantageous and useful for the motion furniture to again be useable in a motorized way, even after such a manual return of the motion furniture to the closed position.

SUMMARY

An aspect of the present disclosure includes a motorized positioning apparatus for a seating unit that includes a motor assembly that is configured to move a pair of linkage mechanisms through a series of positions that arrange the seating unit in a closed position, TV position, or extended position. The motor assembly is selectively and releasably coupled to the linkage mechanisms, to allow the motor assembly to be selectively de-coupled from the linkage mechanisms to allow the seating unit to be manually closed by a user. The term "selectively and releasably coupled" may also be referred to as a selectively coupled state and a releasably coupled state, respectively. In some aspects, a drive block of the motor assembly is selectively coupled and de-coupled from a motor tube that is, in turn, coupled to the pair of linkage mechanisms. In some aspects, coupling mechanisms such as solenoids are used to control pins to selectively couple and de-couple the drive block and the motor tube.

Embodiments of the disclosure are defined by the claims below, not this summary. A high-level overview of various aspects of the disclosure is provided here for that reason, to provide an overview of the disclosure, and to introduce a selection of concepts that are further described below in the detailed-description section below. This summary is not intended to identify key features or essential features of the claimed subject matter, nor is it intended to be used as an aid in isolation to determine the scope of the claimed subject matter.

BRIEF DESCRIPTION OF THE DRAWINGS

This disclosure includes various details that may reference the attached drawing figures, which are incorporated herein by reference, wherein.

DETAILED DESCRIPTION

Figure 1:
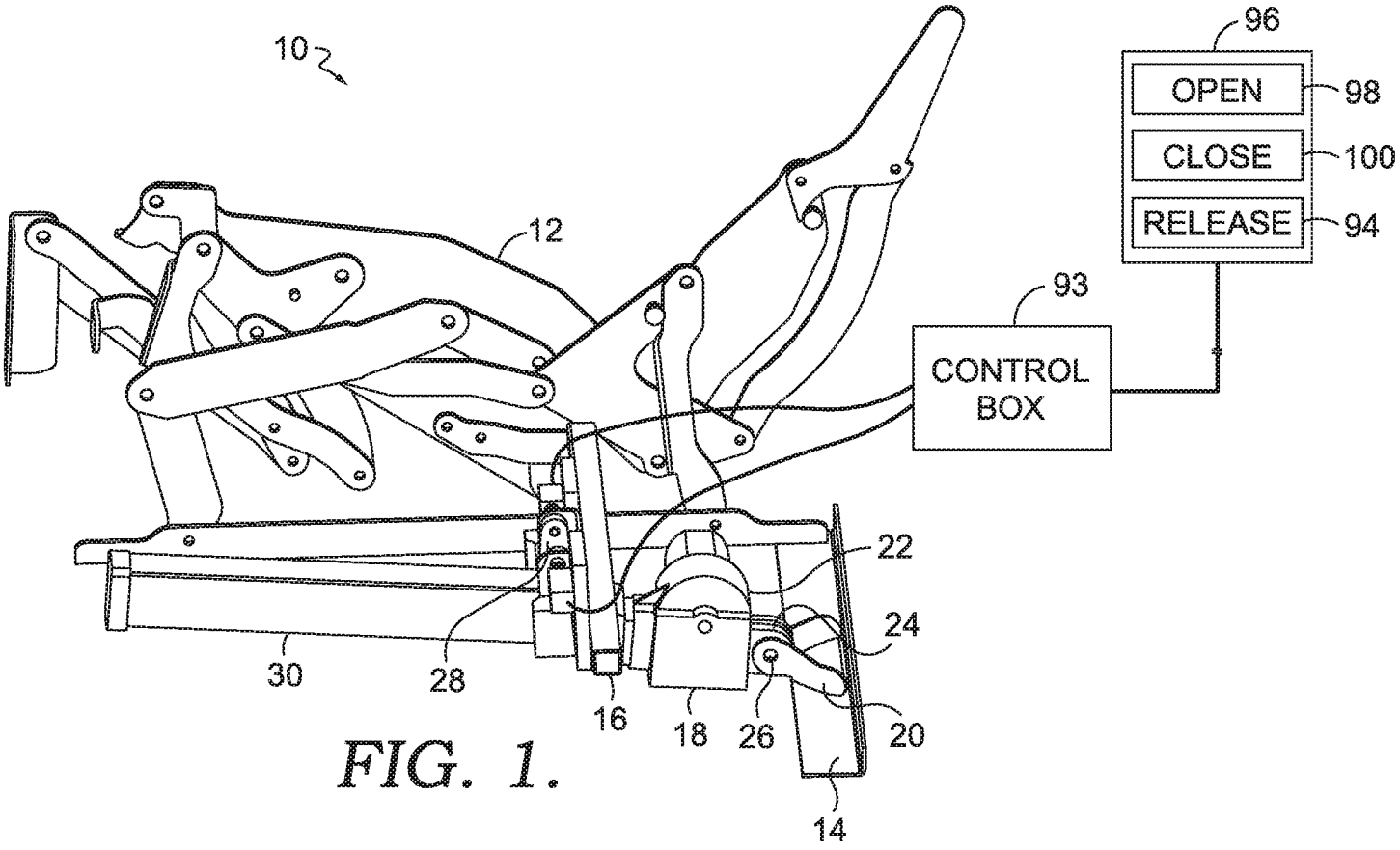
FIG. 1 is a perspective view of a motorized multi-position seating unit, with one linkage mechanism not shown for clarity, with the seating unit in a closed position.

Subject matter is described throughout this disclosure in detail and with specificity in order to meet statutory requirements. But the aspects described throughout this disclosure are intended to be illustrative rather than restrictive, and the description itself is not intended necessarily to limit the scope of the claims. Rather, the claimed subject matter might be practiced in other ways to include different elements or combinations of elements that are similar to the ones described in this disclosure and that are in conjunction with other present, or future, technologies. Upon reading the present disclosure, alternative aspects may become apparent to ordinary skilled artisans that practice in areas relevant to the described aspects, without departing from the scope of this disclosure. It will be understood that certain features and subcombinations are of utility and may be employed without reference to other features and subcombinations. This principle is contemplated by and is within the scope of the claims.

An example of a prior art motion furniture piece is shown and described in U.S. Pat. No. 9,845,852 ("the '852 patent"). As an example, FIG. 6 of the '852 patent is shown in simplified fashion here as FIG. 7, and shows one side of a motion furniture linkage mechanism (text notations have been added to FIG. 7 for explanatory purposes) in the closed position. The side not shown is a mirror-image of the side shown. The two linkage mechanisms are coupled together, such as with a stationary rail such as a rear base rail and/or a front base rail and a motor tube. Each end of the motor tube is coupled to a part of the linkage mechanism. The motor tube is also coupled to an actuator. The actuator (or motor) can be engaged to move a drive block forward, causing the linkage mechanisms to move from the closed position to the TV position to the reclined position. The actuator can also be engaged to move the drive block backward, causing the linkage mechanisms to move from the reclined position to the TV position to the closed position. In the prior art, the motor tube typically has a mounting bracket that is pivotally coupled to the drive block, such that the motor tube always moves with the drive block, and thus the linkage mechanisms always move with the drive tube. The mounting bracket is coupled to the drive block in a pivotal way, such as with a bolt or a clevis pin. This connection is permanent, in that to disengage the motor tube from the drive block requires access to the underside of the motion furniture, and generally requires some type of tool. In effect, this means that the only way to move the linkage mechanisms between the closed position, TV position and reclined position is to activate the actuator or motor to move the drive block and motor tube, thus moving the linkage mechanisms. As noted above, moving from the reclined position to the closed position may take more time than users want, in certain situations.

Many aspects are contemplated in the present application. As described, the pair of linkage mechanisms described herein may arrange a seating unit in a closed position, TV position, or an extended position. The linkage mechanisms may control the positioning of only the ottoman or a combination of the ottoman, a seat, and a backrest. In aspects where the linkage mechanism may only control the positioning of the ottoman, the backrest and the seat may be controlled by an independent linkage mechanism. Even in aspects where the linkage mechanism only controls the positions of the ottoman, the pair of linkage mechanisms may arrange only the ottoman in the closed position, TV position, or the extended position.

FIG. 1 depicts a new coupling arrangement between the linkage mechanisms and the actuator. More specifically, FIG. 1 depicts a motorized seating unit 10, showing a linkage mechanism 12, which is operable to move the motorized seating unit 10 from a closed position (FIG. 1), to a TV position (FIG. 2) and to a reclined position (not shown), and back. Another linkage mechanism of the motorized seating unit 10 is not shown, but would be a mirror-image of the linkage mechanism 12. The linkage mechanism 12, and the opposite linkage mechanism are coupled together at one point by a rear base rail 14, which may be typically made from bent or formed metal. Although a stationary rail such as the rear base rail 14 is illustrated in at least FIG. 1 as coupling the linkage mechanisms together, in some aspects other stationary rails are contemplated to be used. A front base rail may couple the linkage mechanisms together, which may be located opposite the illustrated rear base rail towards the ottoman end of the linkage mechanism 12. In some aspects a combination of the front base rail and the rear base rail may couple the linkage mechanism together.

At another point, the linkage mechanism 12, and the opposite linkage mechanism are coupled together by a motor tube 16. Each end of the motor tube 16 is coupled to a part of the respective linkage mechanism 12, such that, as the motor tube 16 moves, the linkage mechanism 12 moves the seating unit 10 between the closed, TV and reclined positions, and back.

A motor (such an electric linear actuator) 18 is pivotally coupled to the rear base rail 14. For example, a rear motor mounting bracket 20 may be coupled to the rear base rail 14. Similarly, a motor housing 22 may have an integrally-formed bracket 24, or the bracket 24 may be coupled to the motor housing 22. The bracket 24 and the rear motor mounting bracket 20 may be pivotally coupled together, such as by placing a clevis pin 26 through holes in the bracket 24 and the rear motor mounting bracket 20. Other attachment arrangements could also be used to pivotally couple the motor 18 to the rear base rail 14.

In some contemplated aspects, other stationary rails other than the rear base rail 14 may be pivotally coupled to the motor. It is contemplated herein that the motor 18 may pivotally be coupled to the front base rail, described herein.

Figure 2:
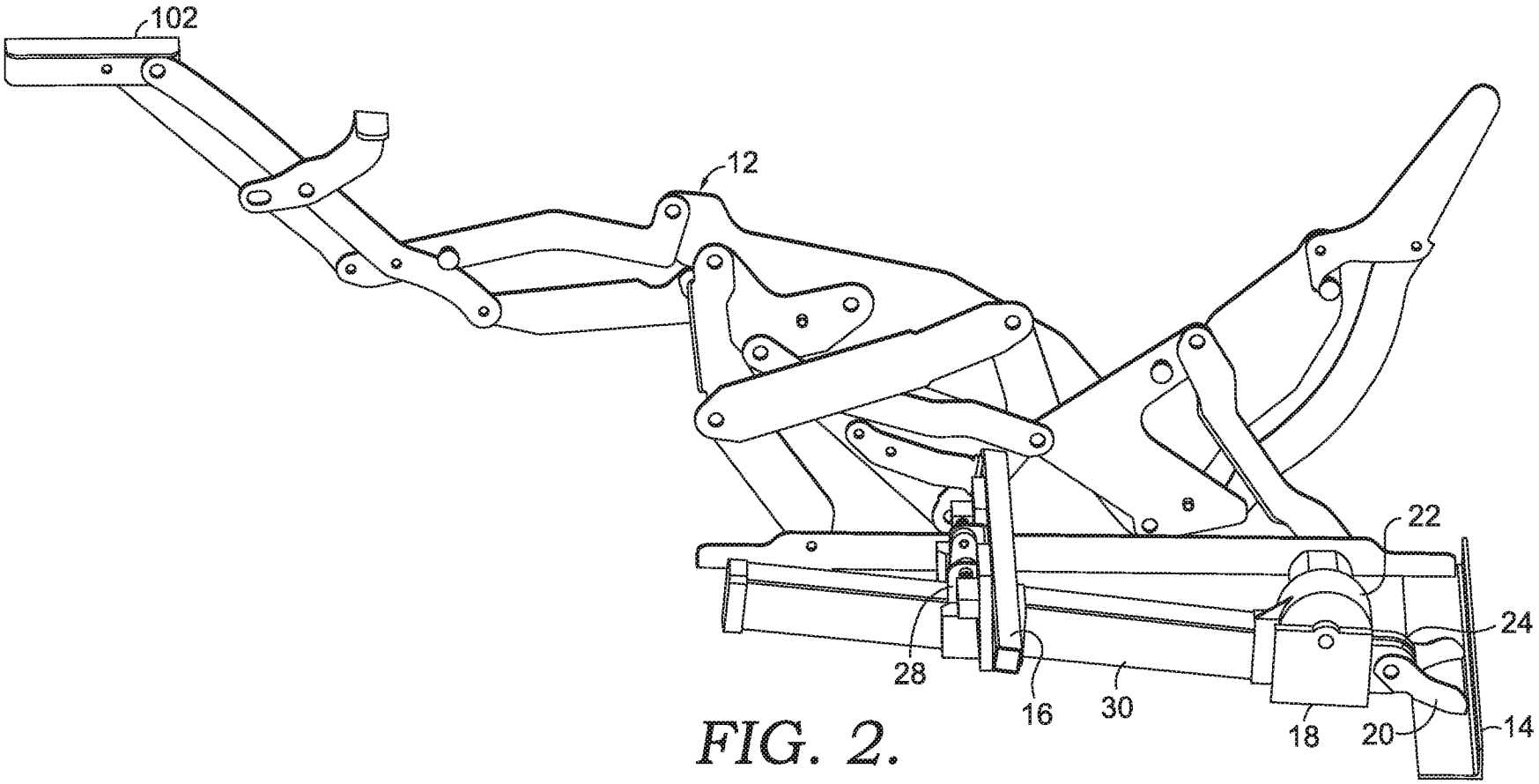
FIG. 2 is a view, similar to that of FIG. 1, with the seating unit in a TV position, where the ottoman has been moved to an extended position and the backrest in the upright position.

As best seen in FIG. 2, the motor 18 is operable to move a drive block 28 along a body 30 of the motor 18. In one aspect, the motor 18 utilizes a worm gear and rack arrangement to selectively move the drive block 28 forward or backward along the body 30. The body 39 may be coupled pivotally along with the motor 18 to a stationary rail such as the rear base rail 14 or the front base rail described herein. In some other aspects the body 30 couple the front and the rear base rails.

Figure 4A:
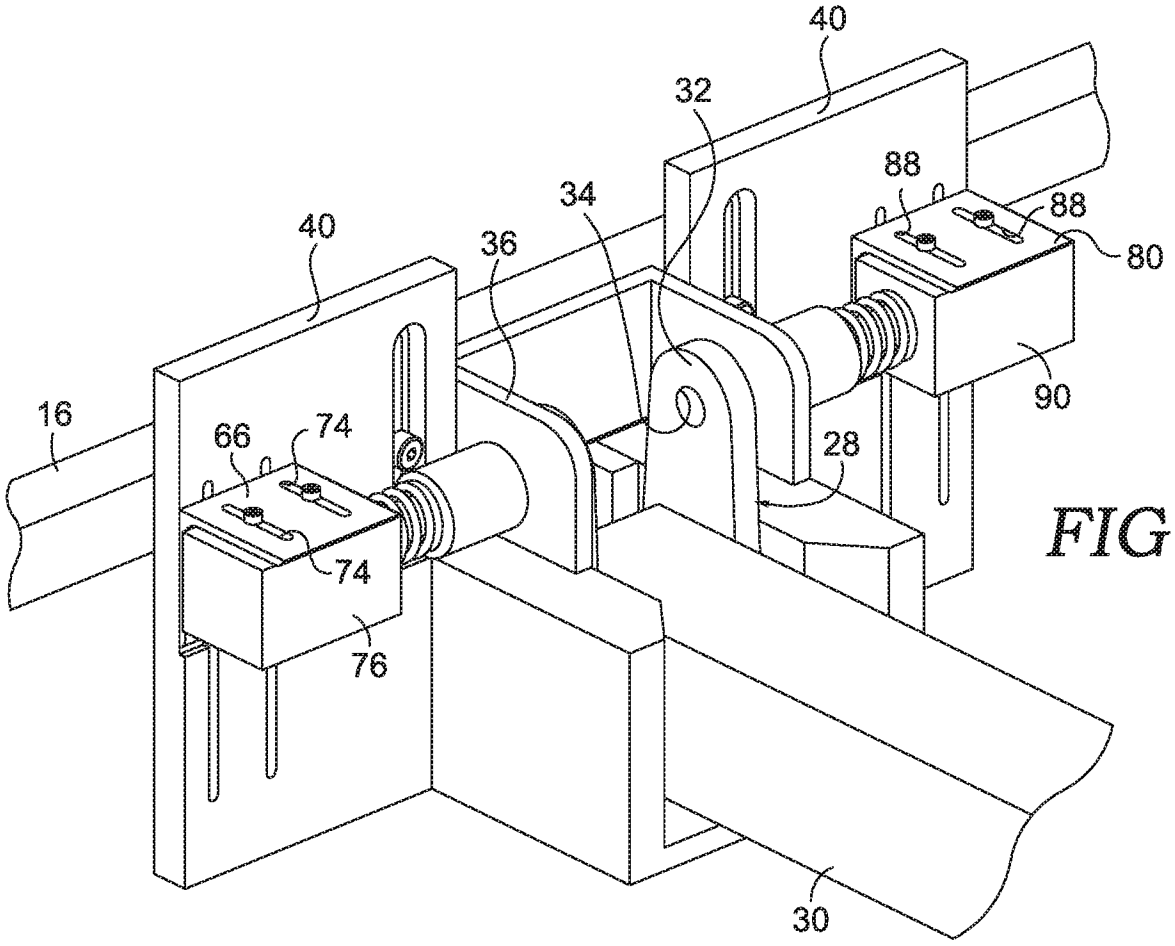
FIG. 4A is an enlarged view showing the drive block and motor de-coupled from the motor tube and linkage mechanism.
Figure 4B:
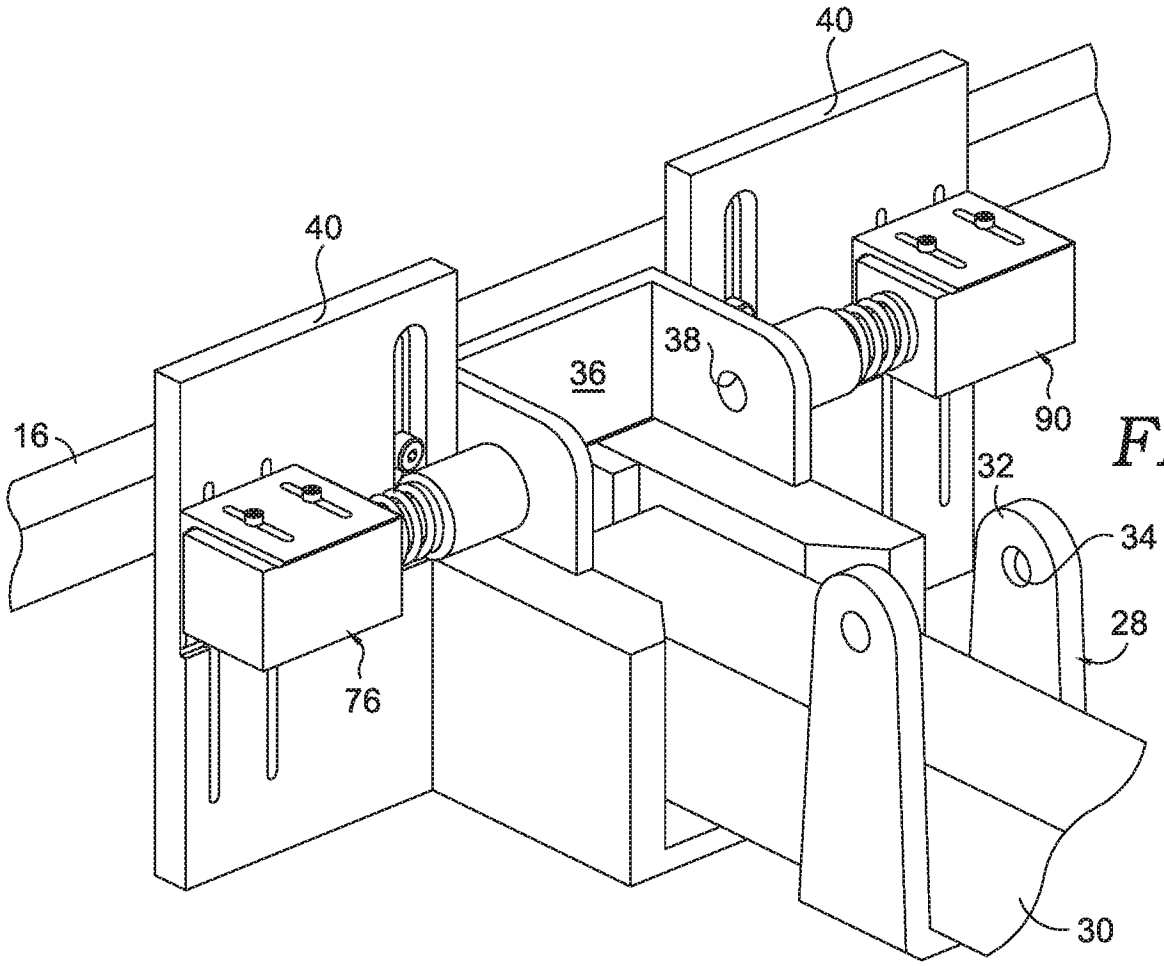
FIG. 4B is a view similar to FIG. 4A, showing the drive block de-coupled from the motor tube and in a different position from that of FIG. 4A.

As best seen in FIG. 4B, the drive block 28 is coupled to a pair of mounting tabs 32, or mounting tabs 32 could be integrally formed with the drive block 28. Each mounting tab 32 includes an aperture 34. Motor tube 16 has a mounting bracket 36 coupled to it, such as by welding, for example. The mounting bracket 36 has a pair of extensions that each have an aperture 38. Apertures 34 on mounting tabs 32 and apertures 38 on bracket 36 are used to selectively couple drive block 28 and motor 18 to motor tube 16 and linkage mechanisms 12.

Figure 5:
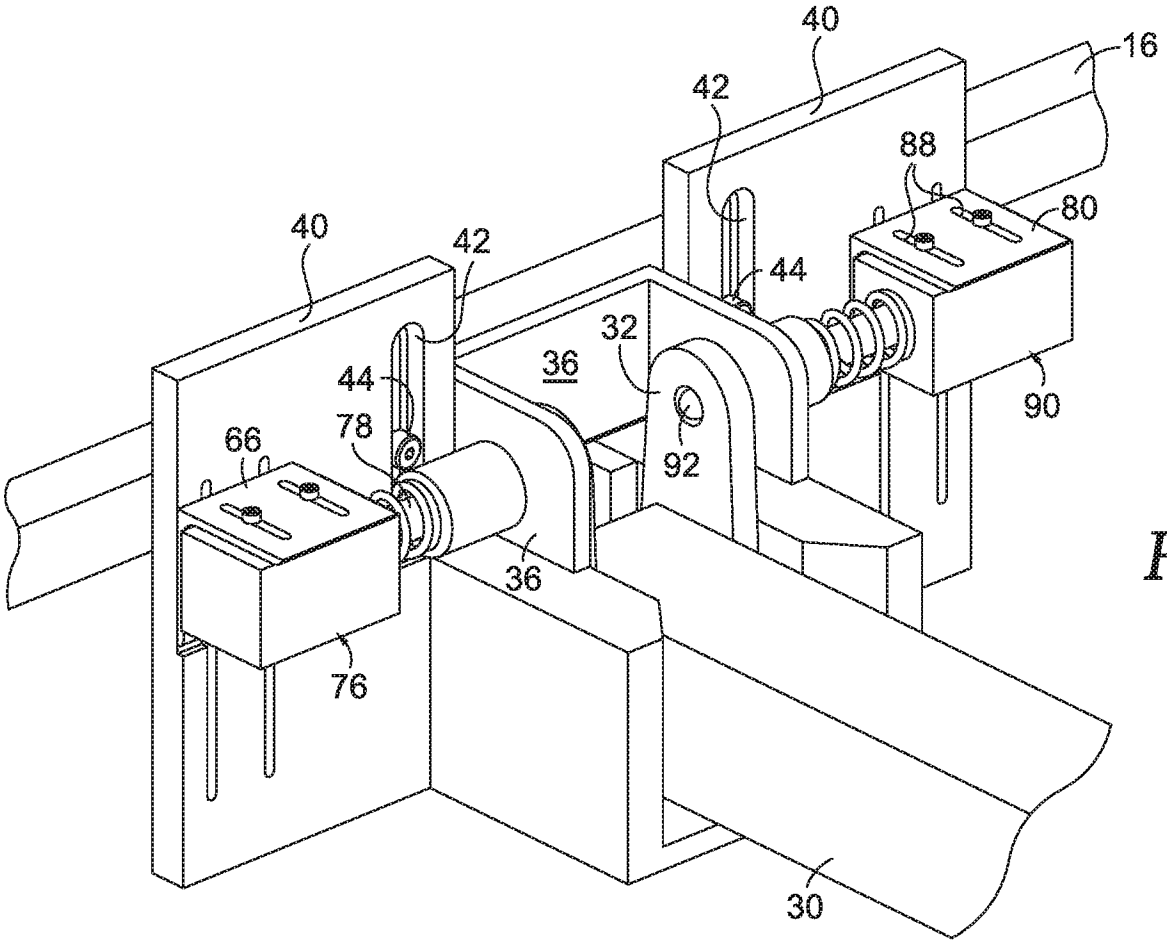
FIG. 5 is a view similar to that of FIG. 4A but showing the pins of the solenoids extended to couple the motor tube and linkage mechanism to the motor and drive block.
Figure 6:
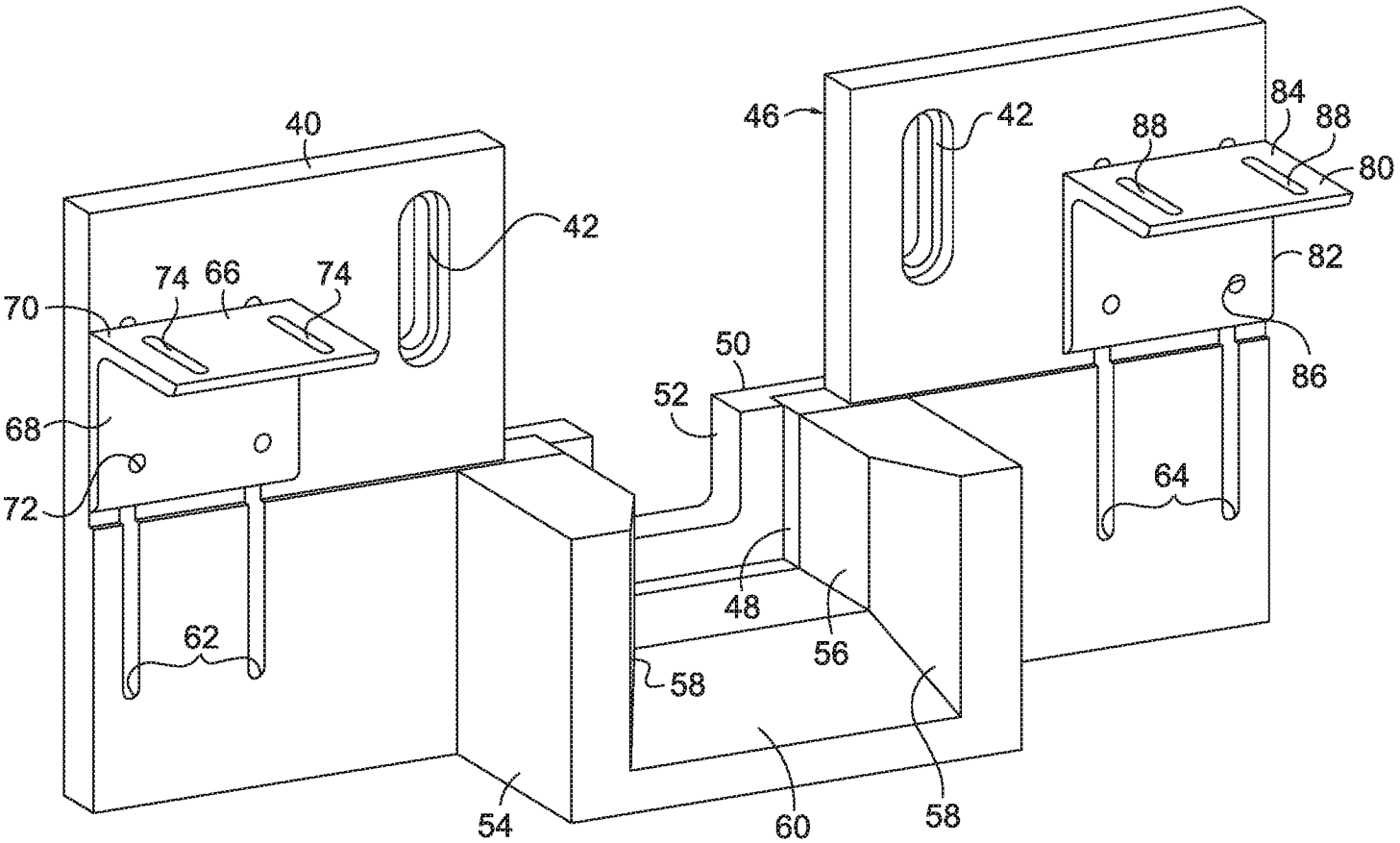
FIG. 6 is an enlarged view of the back plate, shaft insert, guide block and solenoid brackets.
Figure 7:
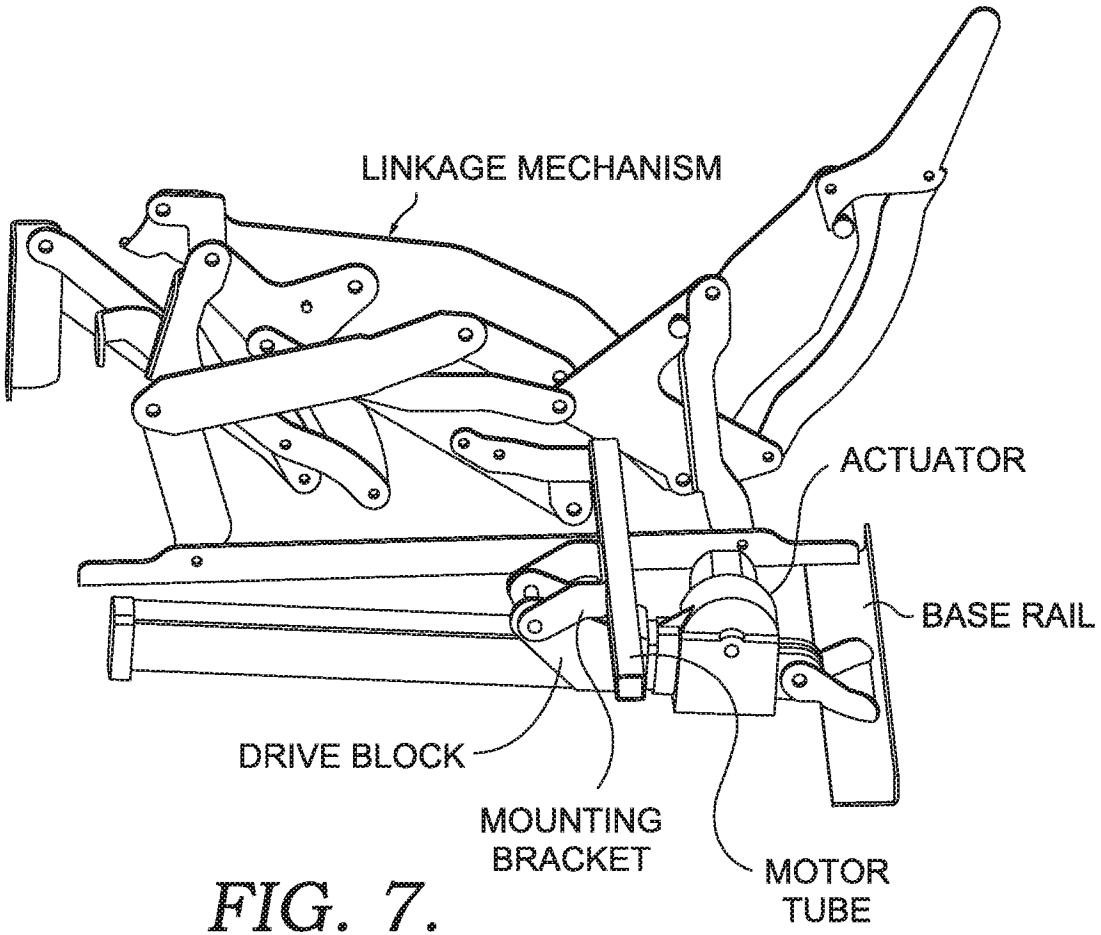
FIG. 7. PRIOR ART
FIG. 7 is an exemplary view of a prior art motorized seating unit.

More specifically, as best seen in FIGS. 5 and 6, a back plate 40 is coupled to motor tube 16. Back plate 40, in some aspects, is made from a sturdy material, such as metal, and includes a first set of elongated slots 42. Slots 42 may be used, in some aspects, to bolt back plate 40 to motor tube 16. In some aspects, motor tube 16 may have corresponding threaded holes through which bolts 44 are threaded, or may have corresponding through-holes in a nut-and-bolt connection arrangement. As best seen in FIG. 6, back plate 40, in some aspects, has a first open section 46 and a second open section 48. As best seen in FIGS. 4A and 4B and 5, when back plate 40 is coupled to motor tube 16, first open section 46 allows mounting bracket 36 (coupled to motor tube 16) to extend through first open section 46. A shaft insert 50 is also coupled to back plate 40, in some aspects just below motor tube 16. Shaft insert 50 is also made of metal and has a generally u-shaped opening 52 formed therein that allows clearance for body 30 of motor 18. In some aspects, the surface of u-shaped opening 52 supports body 30 of motor 18. In some aspects, a guide block 54 is also coupled to back plate 40, on the side of back plate 40 opposite shaft insert 50. Guide block 54, in some aspects, is also made of a metal material. Shaft insert 50 and back plate 40 may, in some aspects, have aligned holes, which also align with threaded holes in guide block 54. Bolts may then be placed through the aligned holes in shaft insert 50 and back plate 40, and threaded into the threaded holes in guide block 54 to couple together the shaft insert 50, back plate 40 and guide block 54. Guide block 54 also has an open channel 56 that transitions to side guide surfaces 58 and bottom guide surface 60. In some aspects, open channel 56 corresponds to the size and shape of second open section 48 in back plate 40. Side guide surfaces 58 and bottom guide surface 60 could be formed as a bevel or chamfer.

Returning to back plate 40, a first pair of adjustment slots 62 are cut or formed on one end of back plate 40 and a second pair of adjustment slots 64 are cut or formed on the other end of back plate 40. The first pair of adjustment slots 62 and the second pair of adjustment slots 64 extend vertically on back plate 40. The first pair of adjustment slots 62 are used to couple a first solenoid bracket 66 to the back plate 40. First solenoid bracket 66 has a first member 68 that is oriented orthogonally to a second member 70. First member 68 and second member 70 can be integrally formed, such as from bent metal or angle-iron. First member 68 has a number of spaced, threaded mounting holes 72 formed therein. Mounting holes 72 are located, in some aspects, such that two mounting holes 72 are aligned with each of the slots in the first pair of adjustment slots 62. Bolts or other attaching mechanisms can then be placed through the first pair of adjustment slots 62 and threaded into mounting holes 72 to secure first solenoid bracket 66 to back plate 40. The first pair of adjustment slots 62 allow the first solenoid bracket 66 to be adjusted vertically on the back plate 40. Second member 70 of the first solenoid bracket 66 includes a pair of slots 74 that extend orthogonally from the plane of back plate 40 when first solenoid bracket 66 is coupled to back plate 40.

As best seen in FIG. 4A, a first solenoid 76 is supported on first solenoid bracket 66, and is coupled to first solenoid bracket 66 with bolts or screws, for example, using slots 74. As best seen in FIG. 5, first solenoid 76 includes a first pin 78. First solenoid 76 can be engaged to retract pin 78, or disengaged to allow pin 78 to extend from first solenoid 76. The reverse could also be true, in that first solenoid 76 could be engaged to extend pin 78 and disengaged to retract pin 78. In either case, first solenoid 76 is operable to actuate pin 78, for example, to selectively extend and retract pin 78.

Similar to the discussion above, and as best seen in FIGS. 4A and 6, the second pair of adjustment slots 64 are used to couple a second solenoid bracket 80 to the back plate 40. Second solenoid bracket 80 has a first member 82 that is oriented orthogonally to a second member 84. First member 82 and second member 84 can be integrally formed, such as from bent metal or angle-iron. First member 82 has a number of spaced, threaded mounting holes 86 formed therein. Mounting holes 86 are located, in some aspects, such that two mounting holes 86 are aligned with each of the slots in the second pair of adjustment slots 64. Bolts or other attaching mechanisms can then be placed through the second pair of adjustment slots 64 and threaded into mounting holes 86 to secure second solenoid bracket 80 to back plate 40. The second pair of adjustment slots 64 allow the second solenoid bracket 80 to be adjusted vertically on the back plate 40. Second member 84 of the second solenoid bracket 80 includes a pair of slots 88 that extend orthogonally from the plane of back plate 40 when second solenoid bracket 80 is coupled to back plate 40. As best seen in FIG. 5, a second solenoid 90 is supported on second solenoid bracket 80, and is coupled to second solenoid bracket 80 with bolts or screws, for example, using slots 88. Second solenoid 90 includes a second pin 92. Second solenoid 90 can be engaged to retract pin 92, or disengaged to allow pin 92 to extend from second solenoid 90. The reverse could also be true, in that second solenoid 90 could be engaged to extend second pin 92 and disengaged to retract second pin 92. In either case, second solenoid 90 is operable to actuate pin 92, for example, to selectively extend and retract second pin 92.

As shown in FIG. 1, first solenoid 76 and second solenoid 90 are coupled to a power source (not shown), a control box 93 and a controller 96. In one aspect, a release button 94 is added to controller 96 for the motorized seating unit 10. Release button 94 is used to communicate a desired change in state for first solenoid 76 and second solenoid 90, as further described below. Controller 96 may also have an open button 98 and a close button 100, for example. Controller 96 is, in some aspects, coupled to control box 93 that receives signals from controller 96 and passes them on to, for example, motor 18, first solenoid 76 and second solenoid 90.

In a first state, (as shown in FIGS. 1, 2 and 5) the first pin 78 of first solenoid 76 and the second pin 92 of second solenoid 90 extend through respective apertures 34 on mounting tabs 32 and respective apertures 38 on bracket 36 thereby coupling drive block 28 and motor 18 to motor tube 16 and linkage mechanisms 12. In this first state, operation of the motor 18 moves the drive block 28 forwardly, such as when a user activates the open button 98, or rearwardly, such as when a user activates the close button 100. From the closed position, shown in FIG. 1, the user can activate the open button 98 to move to the TV position of FIG. 2 for example. Similarly, the user can active the close button 100 to move from the TV position to the closed position.

If the motorized seating unit 10 is in the TV position of FIG. 2, for example, and the user wants to more-quickly exit the motorized seating unit 10 than would be possible using the close button 100 (and waiting for motor 18 to move drive block 28, motor tube 16 and linkage mechanisms 12 to their respective closed positions), the user can press the release button 94. This will change the state of first solenoid 76 and second solenoid 90 to retract first pin 78 and second pin 92, such that first pin 78 and second pin 92 no longer extend through respective apertures 34 on mounting tabs 32 and respective apertures 38 on bracket 36, thereby de-coupling drive block 28 and motor 18 from motor tube 16 and linkage mechanisms 12. In this second state, the user can apply a force to an ottoman link 102 (and the corresponding ottoman, not shown) of the linkage mechanism 12 to manually move the linkage mechanisms 12, and thus the motorized seating unit 10, to a closed position, such as shown in FIG. 3.

Figure 3:
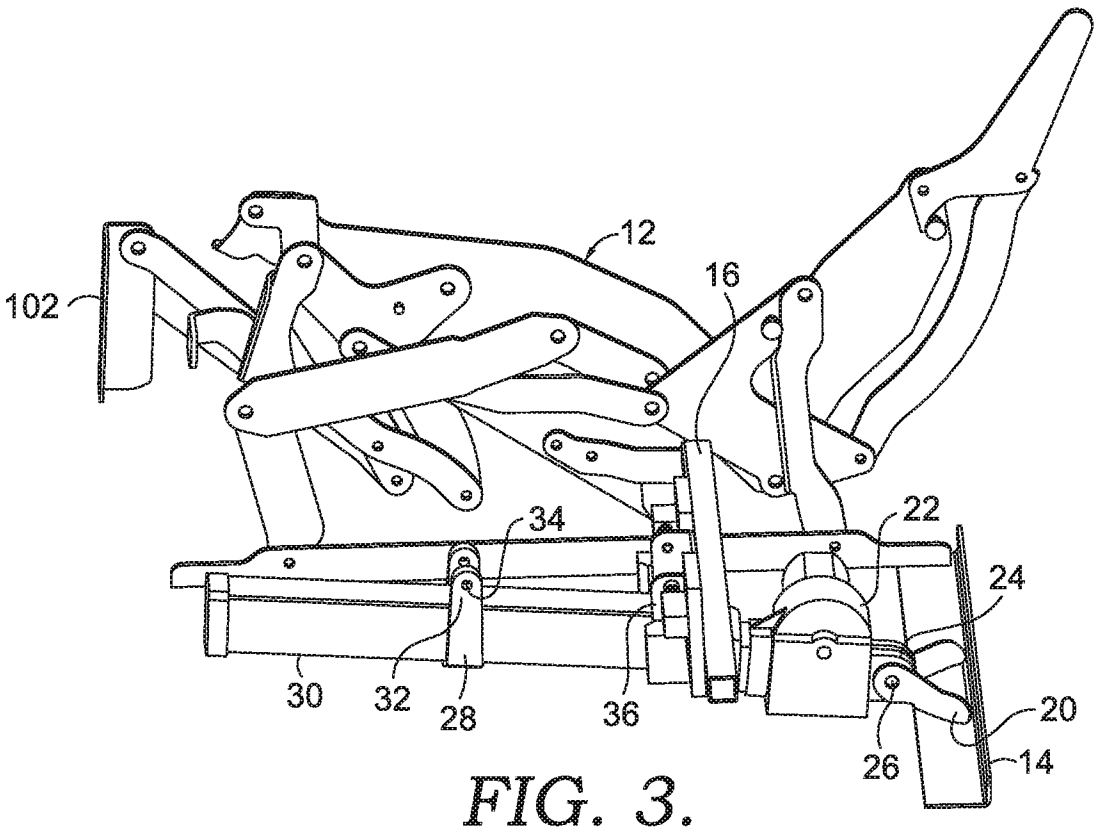
FIG. 3 is a view, similar to that of FIGS. 1 and 2, with the seating unit in a closed position and with the motor and drive block de-coupled from the motor tube and linkage mechanism.

Note that in FIG. 3, the drive block 28 remains in the position it was in in the TV position of FIG. 2, because the drive block 28 is de-coupled from motor drive tube 15. Upon activation of the release button, the control box 93 communicates with the motor 18 to move the drive block 28 to the closed position. FIG. 4B shows drive block 28 slightly before returning to the closed position, and FIG. 4A shows the drive block 28 returned to the closed position. With the linkage mechanisms 12 in the closed position (moved manually by the user), the respective apertures 34 on mounting tabs 32 and respective apertures 38 on bracket 36 are again aligned with first pin 78 and second pin 92. When the drive block 28 reaches the position corresponding to the closed position, the control box 93 signals the first solenoid 76 and the second solenoid 90 to return to the first state, moving first pin 78 and second pin 92 through respective apertures 34 and apertures 38 to re-couple drive block 28 and motor 18 from motor tube 16 and linkage mechanisms 12, such that the open button 98 and close button 100 can be used to move the drive block 28, and thus the linkage mechanisms 12 and seating unit 10 between the closed, TV and reclined positions. FIG. 5 shows first pin 78 and second pin 92 extending through apertures 34, 38 to re-coupled drive block 28 and motor 18 to motor tube 16 and linkage mechanisms 12. In one aspect, the control box 93 may also signal the motor 18 to "jog" or move the drive block 28 slightly forward and then slightly backward to ensure that the first pin 78 and second pin 92 have properly extended through respective apertures 34 and apertures 38.

While first solenoid 76 and second solenoid 90 are described as moving first pin 78 and second pin 92 through apertures 34 and apertures 38, other coupling mechanisms could be used to selectively couple and de-couple drive block 28 and motor 18 to and from motor tube 16 and linkage mechanisms 12 from a remote location, such as a button on controller 96.

Other aspects of coupling between the drive block 28 and motor 18 to and from the motor tube 16 and linkage mechanisms 12 (referred to as a "coupling mechanism") are also contemplated. Each of the aspects below may be used to couple the motor 18 and the drive block 28 to and from motor tube 16 and linkage mechanisms 12 among other implementations described herein. The below references various features shown in FIGS. 1 and 2.

One coupling mechanism may be a wrap-spring clutch used to couple the linkage mechanism to the actuator. In one aspect, the wrap-spring clutch may consist of an input and output hub that attach, respectively, to the motor 18 and drive block 28 to move the drive block 28 forward or backward along the body 30. A helical-wound spring may span the two hubs. The spring inside diameter may be slightly smaller than the outside diameter of the hubs to create an interference fit. Rotating the input hub in the direction of the spring helix may force the spring to wrap down onto the hubs, coupling the motor 18 and drive block 28 without slippage. Stopping the motor 18 or reversing its direction may unwrap the spring and releases the output hub, letting the drive block 28 freely rotate (overrun). Stated differently, wrap-spring clutches may be unidirectional.

Another coupling mechanisms includes a friction clutch. In one aspect, the friction clutch may consist of a receiving mechanism and an engaging mechanism that attach, respectively, to the motor 18 and the drive block 28 to move the drive block 28 forward or backward along the body. Engaging the receiving mechanism with the engaging mechanism may couple the receiving and engaging mechanisms, coupling the motor 18 to the drive block 28. In some aspects, engaging the receiving mechanism with the engaging mechanism may include rotating the engaging mechanism to engage the receiving mechanism. For example, the engaging mechanism may be threaded and be rotated by the motor 18. In that same example, the receiving mechanism may be configured to receive the threaded engaging mechanism, coupling the coupled motor 18 and the drive block 28. In the same example, reversing the rotation of the engaging mechanism may uncouple the engaging mechanism from the receiving mechanism. Stated differently, friction clutches may be bi-directional.

Another coupling mechanism includes the use of a magnetic clutch. In one aspect the magnetic clutch may consist of an armature and an output hub coupled, respectively, to the motor 18 and the drive block 28. The output hub may include a magnetic mechanism, such as a field coil, configured to engage the armature. When the output hub is engaged, a magnetic field may be generated to couple the armature to the output hub, in turn coupling the motor 18 and the drive block 28. The output hub may be disengaged, removing the magnetic field and uncoupling the armature to the output hub. The magnetic field may be generated using a electromagnet or permanent magnet.

In one aspect the coupling mechanism may be a residual magnetic clutch used to couple the linkage mechanism and the actuator. Implementing a residual magnetic clutch, residual magnetic force may be provided to engage the output hub, and when the output hub is disengaged, magnetic force may be stored. In some aspects, the residual magnetic clutch may include a coil with a magnetization current to create a magnetic force to couple the armature with the output hub.

In another aspect, a spring loaded clutch collet may be used as a coupling mechanism. In one aspect, the spring loaded clutch collet may include a round driving member and a receiving member. Each of the round driving member and the receiving member may be coupled, respectively, to the motor 18 and the drive block 28. A spring may be coupled to round driving member and fit closely around the round driving member. The receiving member may be configured to receive the spring and similarly the spring may closely fit around the round driving member. In some aspects the spring is not coupled to the receiving member. The round driving member may engage and couple the receiving member by rotating, via the motor 18, the coupled spring in the direction of the spring helix. When the spring is closely fit around the receiving member the spring may tighten, and couple the round driving member to the receiving member. The round driving member may similarly rotate the opposite direction to disengage the spring from the receiving member. In this way, the spring loaded clutch may couple and uncouple the motor 18 from the drive block 28.

In yet another aspect of a coupling mechanism, a sprag clutch (also referred to as a "one-way clutch") may be implemented. The sprag clutch may include a driving unit and a receiving unit coupled, respectively, to the motor 18 and the drive block 28. The receiving unit may include a plurality of non-revolving asymmetric figure-eight shaped sprags or some other single direction elements. Each of the sprags may tilt slightly when a torque is applied opposite the single direction. The receiving unit may be configured to receive the drive block while engaging the sprags. For example, the sprags may tilt slightly when a torque is applied in a clockwise direction, but each of the sprags may slip or free-wheel when the torque is applied in a counter-clockwise direction. When the drive block rotates clockwise, via the motor 18, the sprags may tilt preventing the drive block from disengaging the receiving unit. In this way, the sprag clutch may couple the linkage mechanism and the actuator.

In another aspect, the control box 93 may automatically re-couple the drive block 28. The control box 93 receives a position of the drive block 28. In some aspects the control box 93 includes a plurality of sensors for determining the position of the drive block 28. In some aspects the plurality of sensors may be in communication with the control box 93 to automatically re-couple the drive block 28.

Figure 8:
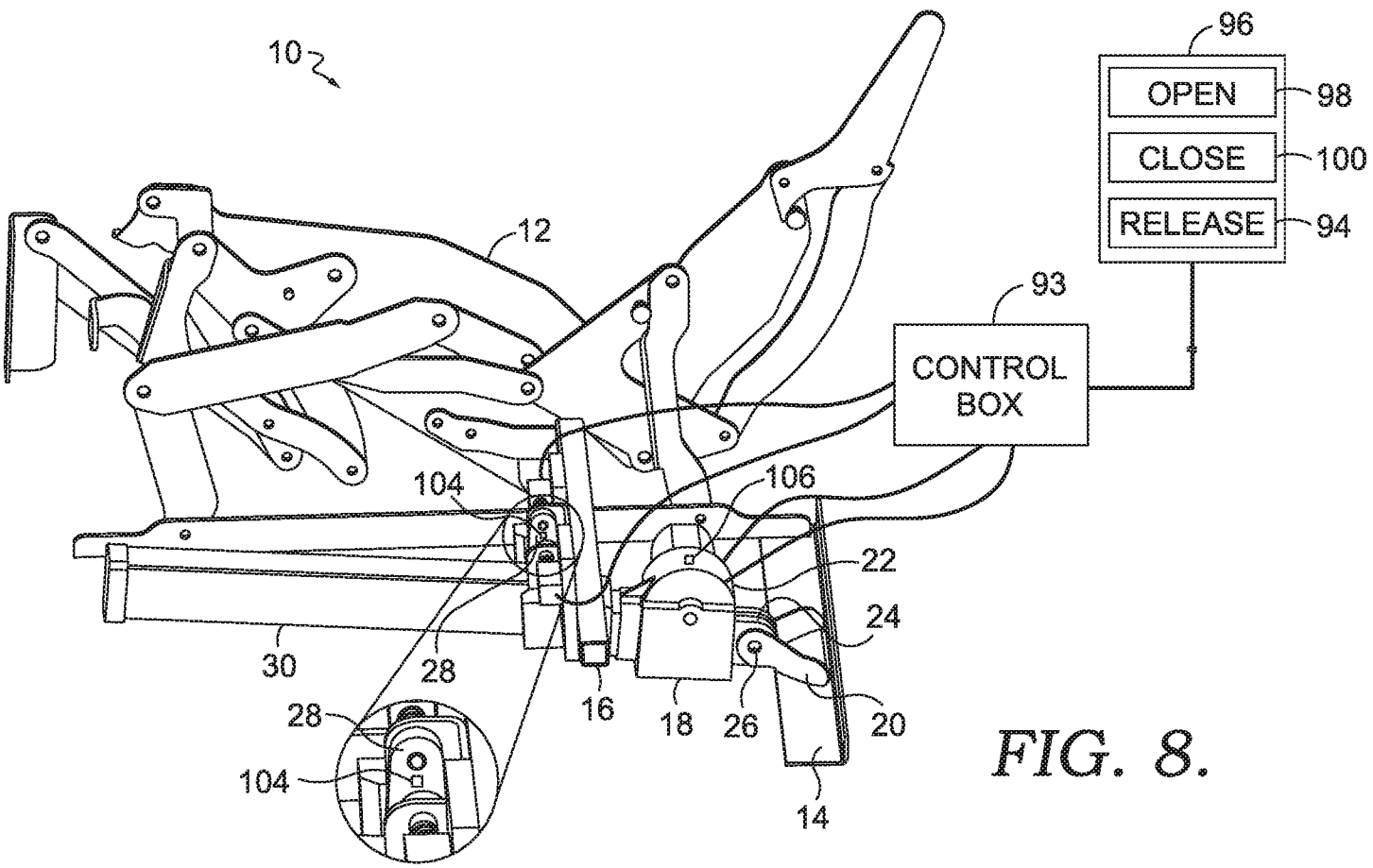
FIG. 8 is a perspective view of an embodiment where the control box automatically re-couple the drive block.

FIG. 8 illustrates aspects where the motor 18 and the drive block 28 may be automatically recoupled to and from motor tube 16 and linkage mechanisms 12. The drive block 28 may be uncoupled in response to an input by a controller 96, as described herein. The drive block 28 may be automatically recoupled to the drive block 28 based on a received indication by the control box 93 of a position that the drive block 28 is in an aligned position with the linkage mechanism 12.

When the coupling mechanism is uncoupled, the drive block 28 may freely move from the linkage mechanism 12. The controller 96 may be in communication with a control box 93 to engage or disengage a coupling mechanism such as with first solenoid 76 and second solenoid 90, or the other coupling mechanisms described herein. The control box 93 may disengage the coupling mechanism, uncoupling the drive block 28 from the linkage mechanism 12. When the drive block 28 is uncoupled from the linkage mechanism 12, a user may manually move the linkage mechanisms 12, such as to close the linkage mechanisms 12. For example, when the drive block 28 is uncoupled from the linkage mechanism 12, a user may apply force on the linkage mechanisms 12, such as at the ottoman link 102 (described in FIG. 2) to close the linkage mechanisms 12. When the linkage mechanisms 12 are in a completely closed position, the drive block 28 may be in the aligned position with the linkage mechanism 12 and couple the coupling mechanism. For example, moving first pin 78 and second pin 92 through respective apertures 34 and apertures 38 to re-couple drive block 28 and motor 18 from motor tube 16 and linkage mechanisms 12, as illustrated in FIGS. 1-6.

The indication of the position may be received from a plurality of sources. As illustrated in FIG. 8, the indication of the position is received from a first sensor 104 and/or second sensor 106. As illustrated, the first sensor 104 is placed on or about the drive block 28 and the second sensor 106 may be placed on or about the motor housing 22. In some aspects the second sensor 106 may be placed on the motor tube 16. The control box 93 may receive indications of position from the first sensor 104 and second sensor 106. The control box 93 may receive indications of position from the first sensor 104 and second sensor 106. Stated differently, the first sensor 104 and second sensor 106 may be in communication with the control box 93.

The control box 93 may determine, based on the received position of the first sensor 104 and/or second sensor 106, an aligned position. The aligned position may indicate a position of the first sensor 104 and/or second sensor 106 where the coupling mechanism may be engaged, coupling the drive block 28 to the motor tube 16. For example, the control box 93 may determine the aligned position by receiving an indication of a position from the first sensor 104 on the drive block 28 that it is at a distal position along the body 30 relative to the motor 18. The second sensor 106 may be on the motor tube 16 and indicate it is at a proximate position along the body 30 relative to the motor 18. The control box 93 may determine the motor tube 16 and drive block 28 are not in a position where the coupling mechanism may be engaged to couple the motor tube 16 to the drive block 28. Instead, when the control box 93 receives a position of the first sensor 104 (on the drive block 28) and second sensor 106 (on the motor tube 16) are at the same location along the body 30, such as at the proximate position along the body 30 relative to the motor 18, the control box 93 may cause to engage the coupling mechanism.

In some aspects, the motor 18 may be a linear actuator with an integrated sensor such as the second sensor 106. For example, the motor 18 may be a linear actuator, where the extension of the motor may move the drive block 28 a commensurate distance. The position of the drive block 28 may be determined by the indication of the position by the motor 18. In another aspect, the motor 18 is a worm gear and rack arrangement where the position of the drive block 28 may be commensurate with a number of rotations of the motor 18. The motor 18 may send the indications of the rotation and/or position of the drive block 28 to the control box 93. The position of the drive block 28 may be determined by the indication of position from the motor 18. In these aspects, the first sensor 104 may be placed on the motor tube 16. The control box 93 may be in communication with the motor 18 and first sensor 104 in these aspects. The control box 93 may determine an aligned position by determining a position of the drive block 28 from the motor 18 and the first sensor 104 on the motor tube 16.

The aligned position may not be a position where the motor tube 16 and the drive block 28 are "aligned". As described herein, the aligned position may be a collinear position of the motor tube 16 and drive block 28 where the coupling mechanism may engage and disengage. In some aspects the motor tube 16 and drive block 28 may not be collinear but offset, where engaging the coupling mechanism may slightly move the motor tube 16 and/or drive block 28 to align the motor tube 16 and drive block 28.

In some aspects, the first sensor 104 may be a proximity sensor to receive a position relative to the second sensor 106. In these aspects, the first sensor 104 may be placed on the drive block 28 and the second sensor 106 may be placed on the motor tube 16. For example, the first sensor 104 may be a proximity sensor that provides an indication of alignment to the control box 93 when the second sensor 106 is within a specified distance.

The control box 93 may determine an aligned position using any combination of the methods and systems described herein. The control box 93 may implement a computer apparatus including processors and memory to reference a data store of conditions (e.g., relative positions as described herein) of the first and or second sensors 104 and 106 that indicate an aligned position. Further, in some aspects, the control box 93 may be electronic mechanical system where an aligned position forms a circuit to engage the coupling mechanism. In some further aspects, the control box 93 may be an electronic mechanical system where an aligned position submits a signal to engage the coupling mechanism.

In various aspects, the control box 93 may engage the coupling mechanism at various positions along the body 30. As described herein, the control box 93 may engage the coupling mechanism at an aligned position where the coupling mechanism may be engaged, coupling the drive block 28 to the motor tube 16. The aligned position may be at a mid-point along the body 30 or anywhere along the body 30. The aligned position may be at a proximate position along the body 30 relative to the motor 18 where the drive block 28 and motor tube 16 are fully drawn in, placing the linkage mechanism 12 in the closed position. In some embodiments, a specific position along the body 30 must be reached by the drive block 28 and motor tube 16 to engage the coupling mechanism. For example, a fully retracted position of the linkage mechanism 12 may position the motor tube 16 at a position along the body 30 at a proximate position from the motor 18. In this example, the drive block 28 may be in an aligned position with the motor tube 16 at the proximate position from the motor 18. In some aspects of this example, the control box 93 may only engage the coupling mechanism when there is an aligned position of the drive block 28 and motor tube 16 at the proximate.

In some aspects, the control box 93 may engage the coupling mechanism at an aligned position while the drive block 28 and/or motor tube 16 are in motion. In some aspects, a user or other external force may actuate the linkage mechanism 12, while the linkage mechanism 12 is actuated, the motor tube 16 may move along the body 30. In these aspects, if during the actuation of the linkage mechanism 12, the drive block 28 and motor tube 16 reach the alignment position, the control box 93 may engage the coupling mechanism while the linkage mechanism 12 and/or drive block 28 are in motion.

Figure 9:
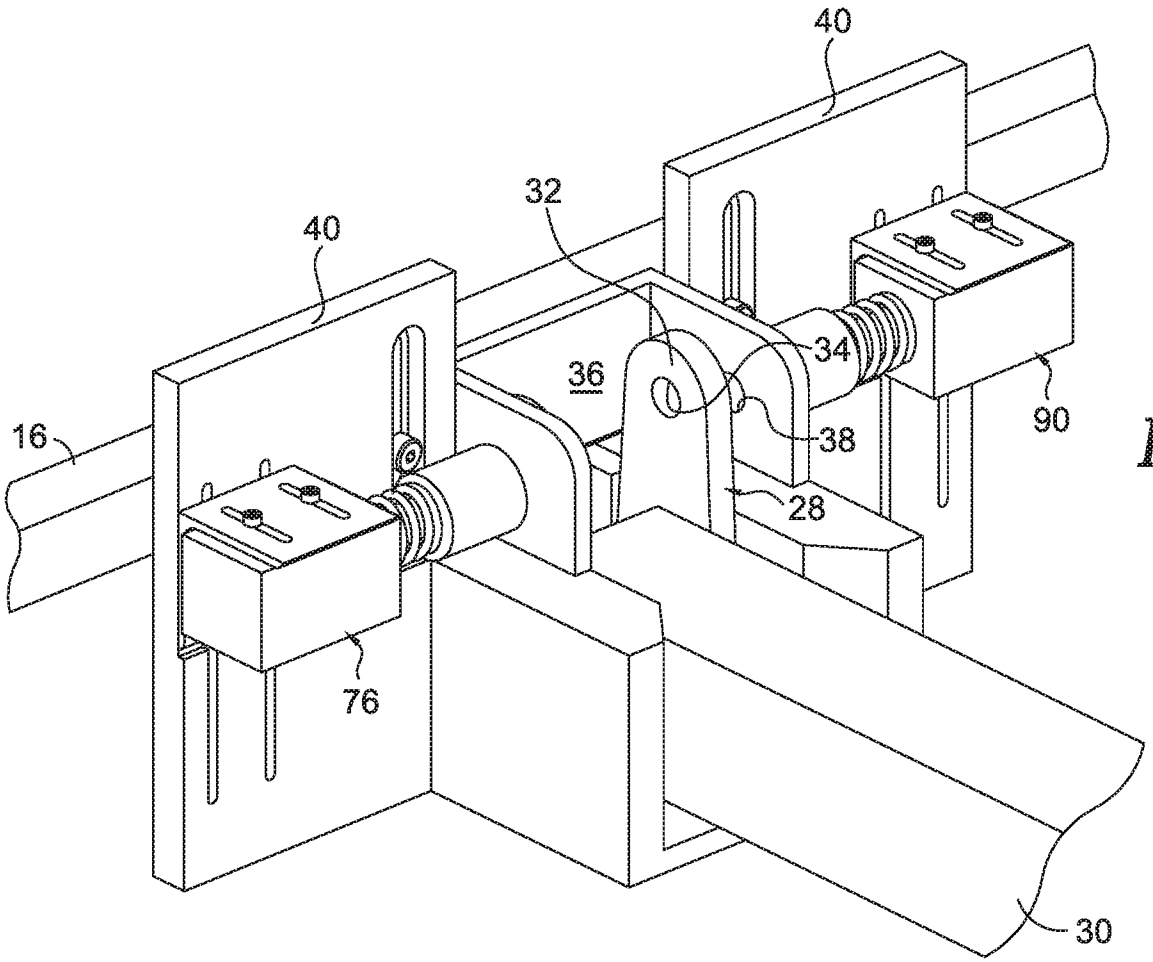
FIG. 9 is an enlarged view showing the drive block and motor de-coupled from the motor tube and engaging the mounting bracket.

Other alternative aspects are also contemplated. FIG. 9, illustrates aspects where the mounting tab 32 may pull the mounting bracket 36 into the closed position.

When the coupling mechanism is released (e.g., automatically or by the release button 94 illustrated and discussed in FIG. 1), the drive block 28 may freely move along the body 30. When released, as described above, the linkage mechanisms 12 may be freely moved. In some aspects, it is contemplated the linkage mechanisms 12 may not be placed in the closed position (as described with regard to FIG. 8) when manually adjusted while the coupling mechanism is released.

The drive block 28 may contact the mounting bracket 36 to place the linkage mechanism 12 into the closed position. The drive block 28 may contact the mounting bracket 36 by the drive block 28 shifting toward the mounting bracket 36. The drive block 28 may shift, in some aspects, along the body 30 beyond the alignment position (as described with regard to FIG. 8) to bring the mounting tab 32 to contact the mounting bracket 36. In some aspects the mounting tab 32 may abut the mounting bracket 36. The drive block 28 may then be shifted along the body 30 toward the closed position, simultaneously moving the mounting bracket 36 and the linkage mechanism 12 to the closed position.

With reference to FIGS. 8 and 9, in some aspects, the control box 93 may determine the linkage mechanism 12 is not in the closed position. The control box 93 may cause to activate the drive block 28 to contact the mounting bracket 36 to place the linkage mechanism 12 into the closed position. In some aspects, the control box 93 may cause to place the linkage mechanism 12 into the closed position by the drive block before engaging the coupling mechanism.

From the foregoing, it will be seen that aspects herein are well adapted to attain all the ends and objects hereinabove set forth together with other advantages which are obvious and which are inherent to the structure. It will be understood that certain features and subcombinations are of utility and may be employed without reference to other features and subcombinations. This is contemplated by and is within the scope of the claims. Since many possible aspects may be made without departing from the scope thereof, it is to be understood that all matter herein set forth or shown in the accompanying drawings is to be interpreted as illustrative and not in a limiting sense.

The invention claimed is:

1. A motorized positioning apparatus for a seating unit, the apparatus comprising:

a pair of substantially mirror-image linkage mechanisms having a plurality of links controlling movement of an ottoman;

a stationary rail coupled between the pair of linkage mechanisms;

a motor tube coupled to at least one of the plurality of links of each linkage mechanism;

a motor assembly comprising a body coupled to the stationary rail and a drive block slidably traversing the body;

a coupling mechanism to selectively and releasably couple the drive block to the motor tube; and a control box to determine a position of the drive block and the motor tube and engage the coupling mechanism at the position coupling the drive block to the motor tube.

2. The motorized positioning apparatus of claim 1, wherein the coupling mechanism comprises a back plate coupled to the motor tube, and a pair of solenoid brackets to selectively and releasably couple the motor tube and the drive block.

3. The motorized positioning apparatus of claim 2, wherein the drive block comprises a pair of mounting tabs with an aperture;

wherein the pair of solenoid brackets actuate a pair of pins to be received by the aperture of the pair of mounting tabs when the solenoid bracket is engaged; and further wherein the pair of solenoid brackets selectively and releasably couple the motor tube to the drive block by actuating the pair of pins to be received by the aperture in response to an input.

4. The motorized positioning apparatus of claim 3, further comprising a controller, wherein the input is received by the controller to dis-engage the coupling mechanism and uncouple the motor tube to the drive block.

5. The motorized positioning apparatus of claim 2, wherein the back plate comprises a pair of adjustment slots extending vertically on the back plate to receive and couple the pair of solenoid brackets at a position to selectively and releasably couple the motor tube to the drive block.

6. The motorized positioning apparatus of claim 2, wherein the back plate comprises an opening to receive and support the body of the motor.

7. The motorized positioning apparatus of claim 1, wherein the motor assembly comprises a worm gear and rack arrangement to slidably move the drive block across the body.

8. The motorized positioning apparatus of claim 1, wherein the coupling mechanism coupling the drive block to the motor tube and the stationary rail comprises at least one of a friction clutch, a sprag clutch, a spring loaded clutch, a magnetic clutch, a residual magnetic clutch, or a friction clutch.

9. A motorized positioning apparatus for a seating unit, the apparatus comprising:

a pair of substantially mirror-image linkage mechanisms having a plurality of links controlling movement of an ottoman;

a stationary rail coupled between the pair of substantially mirror-image linkage mechanisms;

a motor tube coupled to at least one of the plurality of links of each linkage mechanism;

a motor assembly comprising a body coupled to the stationary rail and a drive block slidably traversing the body, the drive block comprising a mounting bracket;

a coupling mechanism coupled to the motor tube and selectively coupled with the mounting bracket, wherein engaging the coupling mechanism couples the coupling mechanism with the mounting bracket; and a control box to receive a position of the mounting bracket relative to the coupling mechanism, determine the position indicates the mounting bracket is aligned with the coupling mechanism, and engage the coupling mechanism with the mounting bracket based on the determination the mounting bracket is aligned with the coupling mechanism.

10. The motorized positioning apparatus of claim 9, further comprising a stationary rail coupled between the pair of pair of substantially mirror-image coupling mechanisms.

11. The motorized positioning apparatus of claim 9, wherein dis-engaging the coupling mechanism uncouples the coupling mechanism with the mounting bracket; and wherein the motorized positioning apparatus further comprises a controller for receiving an input, and wherein the input received by the controller dis-engages the coupling mechanism with the mounting bracket.

12. The motorized positioning apparatus of claim 9, wherein the motor assembly comprises a motor operable to move the drive block along the body.

13. The motorized positioning apparatus of claim 9, wherein the coupling mechanism comprises a pair of solenoid brackets comprising a pair of pins, wherein engaging the coupling mechanism comprises engaging a pair of pins receivable by an aperture of the mounting bracket.

14. The motorized positioning apparatus of claim 9, further comprising a back plate coupled to the motor tube, wherein the back plate couples the coupling mechanism to the motor tube and wherein the back plate comprises an opening to receive the body.

15. The motorized positioning apparatus of claim 14, wherein the back plate is slidably moveable along the body moving the motor tube and the pair of mirror-image linkage mechanisms controlling movement of the ottoman.

16. A motorized positioning apparatus for a seating unit, the apparatus comprising:

a pair of substantially mirror-image linkage mechanisms having a plurality of links controlling movement of an ottoman, a backrest, and a seat;

a rear base rail coupled between the pair of linkage mechanisms;

a motor tube coupled to at least one of the plurality of links of each linkage mechanism;

a motor assembly comprising a body coupled to the rear base rail, a drive block, a mounting bracket comprising an aperture, and a motor coupled to the drive block to slidably move the drive block along the body;

a coupling mechanism coupled to the motor tube and selectively coupled with the mounting bracket, wherein dis-engaging the coupling mechanism uncouples the coupling mechanism with the mounting bracket by the aperture and engaging the coupling mechanism couples the coupling mechanism with the mounting bracket;

a controller to receive an input and wherein the input received dis-engages the coupling mechanism with the mounting bracket at a first position along the body; and a control box to engage the coupling mechanism with the mounting bracket at a second position along the body.

17. The motorized positioning apparatus of claim 16, wherein the second position is a proximate position along the body relative to the motor assembly and the first position is a distal position along the body relative to the motor assembly.

18. The motorized positioning apparatus of claim 16, wherein the selectively coupled state enables movement of the drive block along the body to move the motor tube and actuate the pair of substantially mirror-image linkage mechanisms.

19. The motorized positioning apparatus of claim 16, wherein the control box receives an indication of a position of the mounting bracket along the body and engages the coupling mechanism when the control box receives an indication of the mounting bracket at the second position.

20. The motorized positioning apparatus of claim 16, wherein the control box receives an indication of a state from the motor assembly corresponding to a position of the mounting bracket along the body and engages the coupling mechanism when the control box receives an indication of the state of the motor assembly corresponding to the second position.

* * * * *